US006974403B2

(12) United States Patent
Wong et al.

(10) Patent No.: US 6,974,403 B2
(45) Date of Patent: Dec. 13, 2005

(54) 10K STEP EXERCISE METHOD AND APPARATUS

(75) Inventors: Philip Lim-Kong Wong, Geddington, Kettering (GB); Ka Yiu Sham, Great Falls, VA (US)

(73) Assignee: Acumen, Inc., Sterling, VA (US)

( * ) Notice: Subject to any disclaimer, the term of this patent is extended or adjusted under 35 U.S.C. 154(b) by 11 days.

(21) Appl. No.: 10/466,871

(22) PCT Filed: Jan. 18, 2002

(86) PCT No.: PCT/US02/01218

§ 371 (c)(1),
(2), (4) Date: Jul. 18, 2003

(87) PCT Pub. No.: WO02/056969

PCT Pub. Date: Jul. 25, 2002

(65) Prior Publication Data

US 2004/0063547 A1 Apr. 1, 2004

Related U.S. Application Data

(60) Provisional application No. 60/262,068, filed on Jan. 18, 2001.

(51) Int. Cl.[7] ..... A63B 21/00

(52) U.S. Cl. ..... 482/8; 482/9; 482/900

(58) Field of Search ..... 482/1–9, 51, 54, 482/900–902

(56) References Cited

U.S. PATENT DOCUMENTS

| | | | | |
|---|---|---|---|---|
| 5,209,710 A | | 5/1993 | Shimizu et al. | |
| 5,234,392 A | | 8/1993 | Clark | |
| 5,931,763 A | * | 8/1999 | Alessandri | 482/4 |
| 6,009,375 A | | 12/1999 | Sakumoto et al. | |
| 6,746,371 B1 | * | 6/2004 | Brown et al. | 482/8 |
| 6,808,472 B1 | * | 10/2004 | Hickman | 482/8 |

* cited by examiner

*Primary Examiner*—Glenn E. Richman
(74) *Attorney, Agent, or Firm*—Crowell & Moring LLP

(57) ABSTRACT

An exercise method and apparatus for ensuring the completion of a predetermined number of steps each day as part of an exercise routine by integrating steps taken during a normal daily routine with steps taken on a treadmill or stepper machine.

7 Claims, 5 Drawing Sheets

*Part B: Completing the "10000 steps per day"*

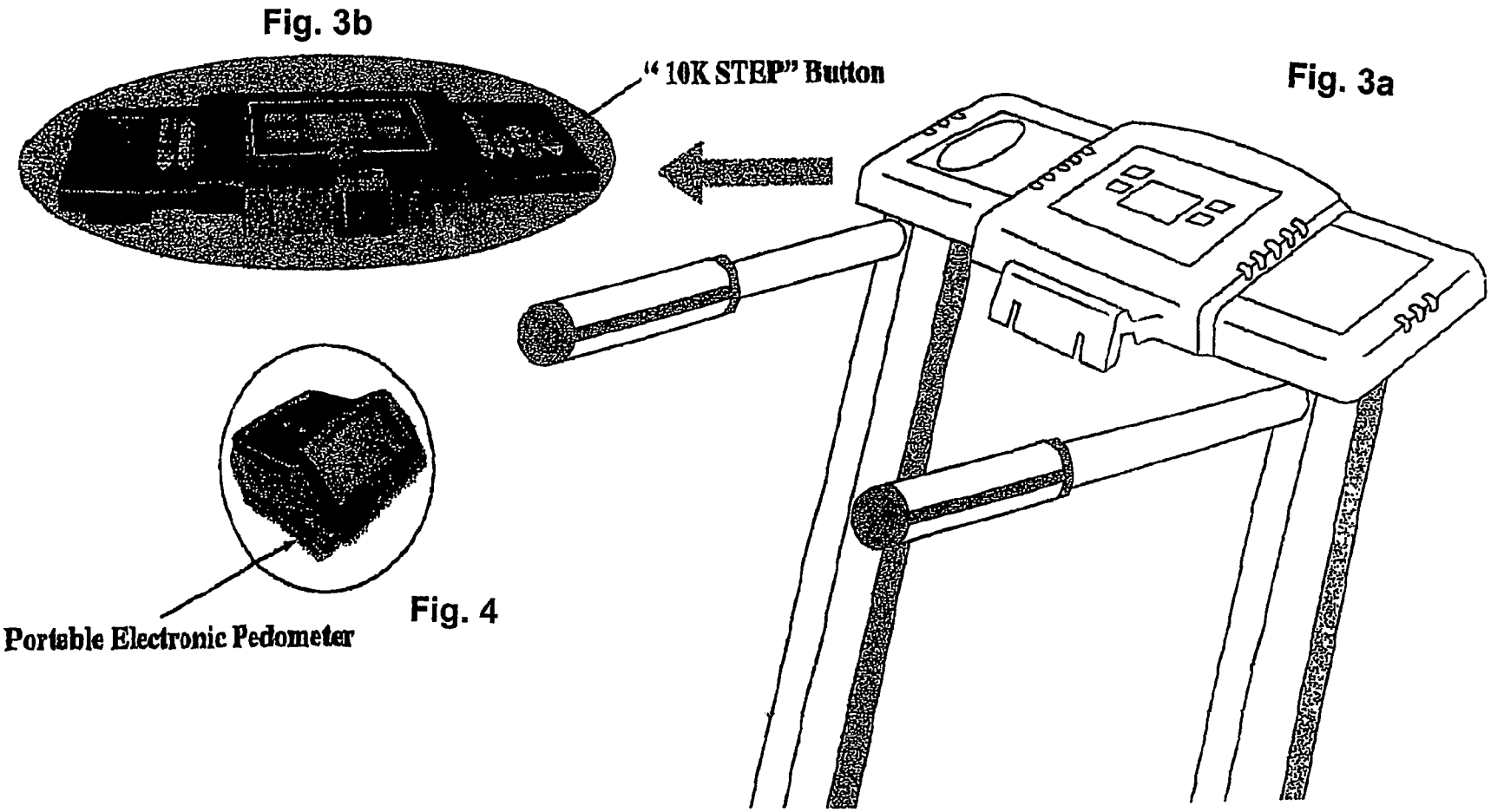
A treadmill console featuring "10K Steps" program used in conjunction with a portable pedometer 10000 Steps Stepper Flow Chart
(V1.0)

Schematic of electronic pedometer

10K STEP EXERCISE METHOD AND APPARATUS

This application claims the priority of U.S. Provisional Application No. 60/262,068, filed Jan. 18, 2001, the disclosures of which is expressly incorporated by reference herein.

BACKGROUND AND SUMMARY OF THE INVENTION

The present invention relates to a method and apparatus for exercise users easily to help reaching their common goal of completing "10,000 steps a day", i.e., 10K steps, so that exercise becomes part of a daily routine and fitness is achieved through regular exercise.

The successful maintenance of an exercise program is often hindered by uncertainty in the amount of exercise being completed during the day. This is especially true when the goal of the program is to burn a certain number of calories per day or to cover a certain distance by walking each day. Exercise carried out outside of the formalized program may vary from day to day and is essentially an unknown factor. Therefore, the amount of walking on the treadmill necessary to attain a certain goal each day depends on the number of steps completed during the rest of the day outside of the formalized exercise on the treadmill.

The 10K steps per day program, while an effective method of ensuring satisfactory performance of a daily routine, often leads to uncertainty as to the amount of exercise already performed outside of the treadmill use or involves a restriction on the type of exercise being performed. That is, jogging, walking and other exercises performed aside from the treadmill, constitute an unknown factor as far as its contribution to the overall 10K steps per day program or requires careful calculations and estimates in order to determine how much of the 10K steps per day were performed before exercising on to the treadmill.

The method and apparatus of the present invention advantageously combine a treadmill and a pedometer, by calibrating the strike-length electronically and storing that calibrated strike-length inside the treadmill for later use, (strike-length data for pedometer input use also), thereafter completing the 10,000 (10K) steps each day as an increasingly routine, simple task.

The present invention achieves these objects by using a pedometer to accumulate the total number of steps whenever the exercise user is walking (or even while shopping), jogging during a day; he/she can transfer the total steps accumulated during the day to a treadmill. The treadmill, with the stored strike-length, is programmed to calculate the difference between the steps already made and the 10,000 (10K) steps.

A final "distance/time" workout program is then presented, displaying the "count-down" as to the remaining number of steps. Also, running at a pre-set user comfortable speed, the user is prompted to finish the necessary workout (steps), i.e. accomplishing 10,000 (10K) steps a day exercise with ease.

The present invention is implementable in a software program/module with the addition of a "10K-Steps" or the like push button added to a treadmill console.

BRIEF DESCRIPTION OF THE DRAWINGS

Other objects, advantages and novel features of the present invention will become apparent from the following detailed description of the invention when considered in conjunction with the accompanying drawings.

FIG. 3A is a perspective partial view of a treadmill console featuring "10K Steps" program in conjunction with a pedometer;

FIG. 3B is a view of the "10-K" step button used on the console of the treadmill shown in FIG. 3A;

FIG. 4 is a perspective of a conventional type of electronic pedometer;

DETAILED DESCRIPTION OF THE DRAWINGS

The person seeking to exercise using the present invention will have a portable electronic pedometer of the type shown in FIG. 4, such pedometers being commercially available, as well as access to a stepper machine such as shown in FIG. 3A to which has been added a "10K step" button such as shown in FIG. 3B. The 10K step method and apparatus are extremely simple to implement in software and hardware, and to use by the exerciser.

Specifically, the exerciser uses the pedometer in its normal fashion to accumulate the total number of steps whenever he or she is walking, whether that walking be involved with an exercise program, shopping, jogging or the like. The steps accumulated by the pedometer during the day are then transferred to a treadmill. Alternatively, this exercise technique can be used in connection with a stepper (FIG. 5), an elliptical machine or other similar device where steps are utilized.

The strike-length is calibrated using a target distance traveled by a user on the treadmill at a comfortable speed. Once the target distance has been reached (100 feet) in the example of FIG. 1, the treadmill stops and a reading of the number of steps can be input from the pedometer. Subsequent, the strike-length or distance for each step is calculated based on the distance of the treadmill divided by the number of steps taken on the treadmill to accomplish that distance. If the strike-length is within a maximum and minimum range, then it is saved into an EEPROM (electrically erasable programmable read-only memory).

Figure 1:
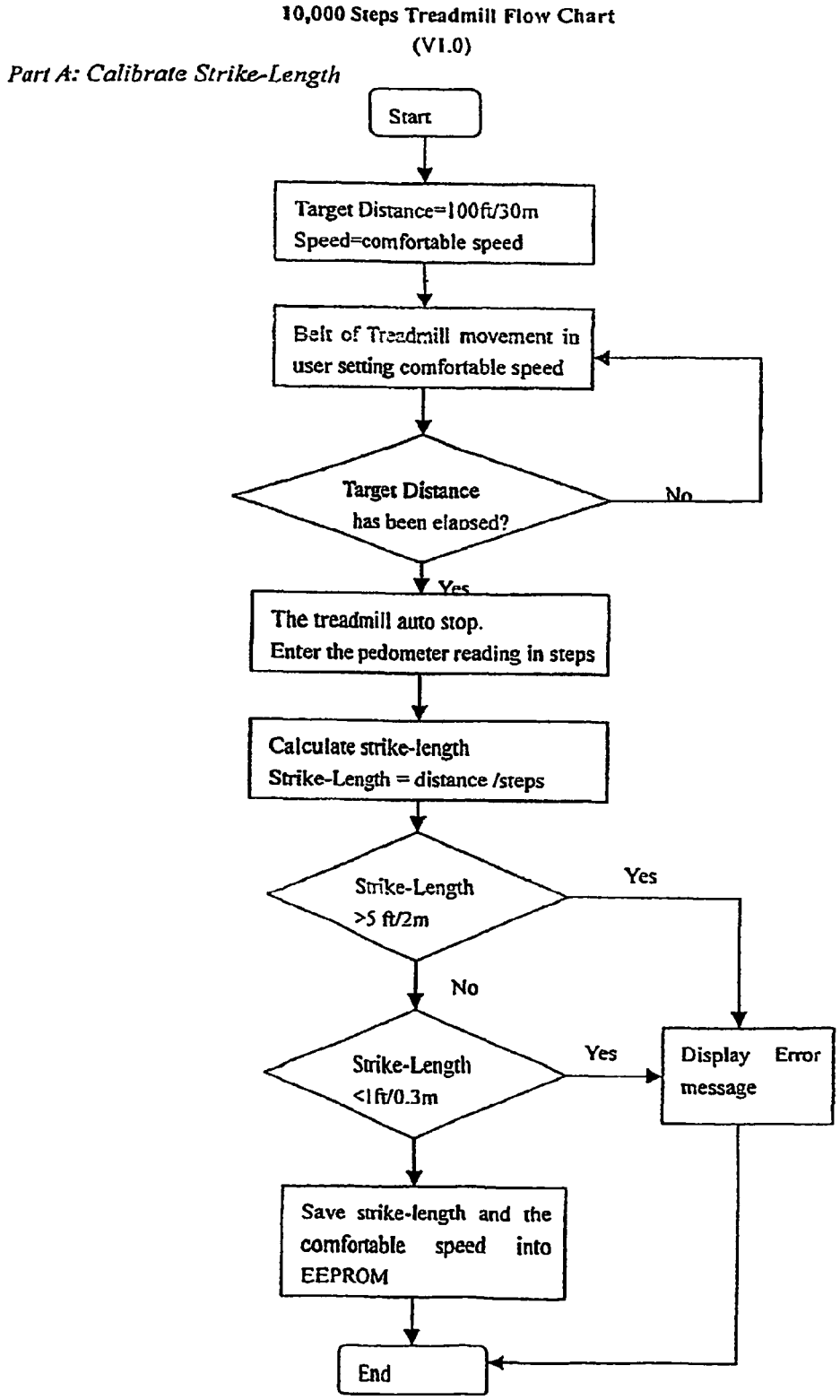
FIG. 1 is a flow chart (Part A) showing how to calibrate Strike=Length (calibrated once only for a treadmill)

As shown in FIG. 1, the exerciser's strike-length has been calibrated and stored in the treadmill memory. Thereby, when the exerciser transfers the total steps accumulated during the day in the pedometer to the input of the treadmill, the treadmill system calculates the difference in steps already made and the goal of the 10,000 (10K) steps.

After this calculation takes place, a final "distance/time" workout program showing a "count up" to 10,000 steps or "count down" in the remaining number of steps in the display. Running at a preset user comfortable speed, the user is prompted to finish the final number of steps required to accomplish the 10,000 steps in an appropriate and easy manner.

Figure 2:
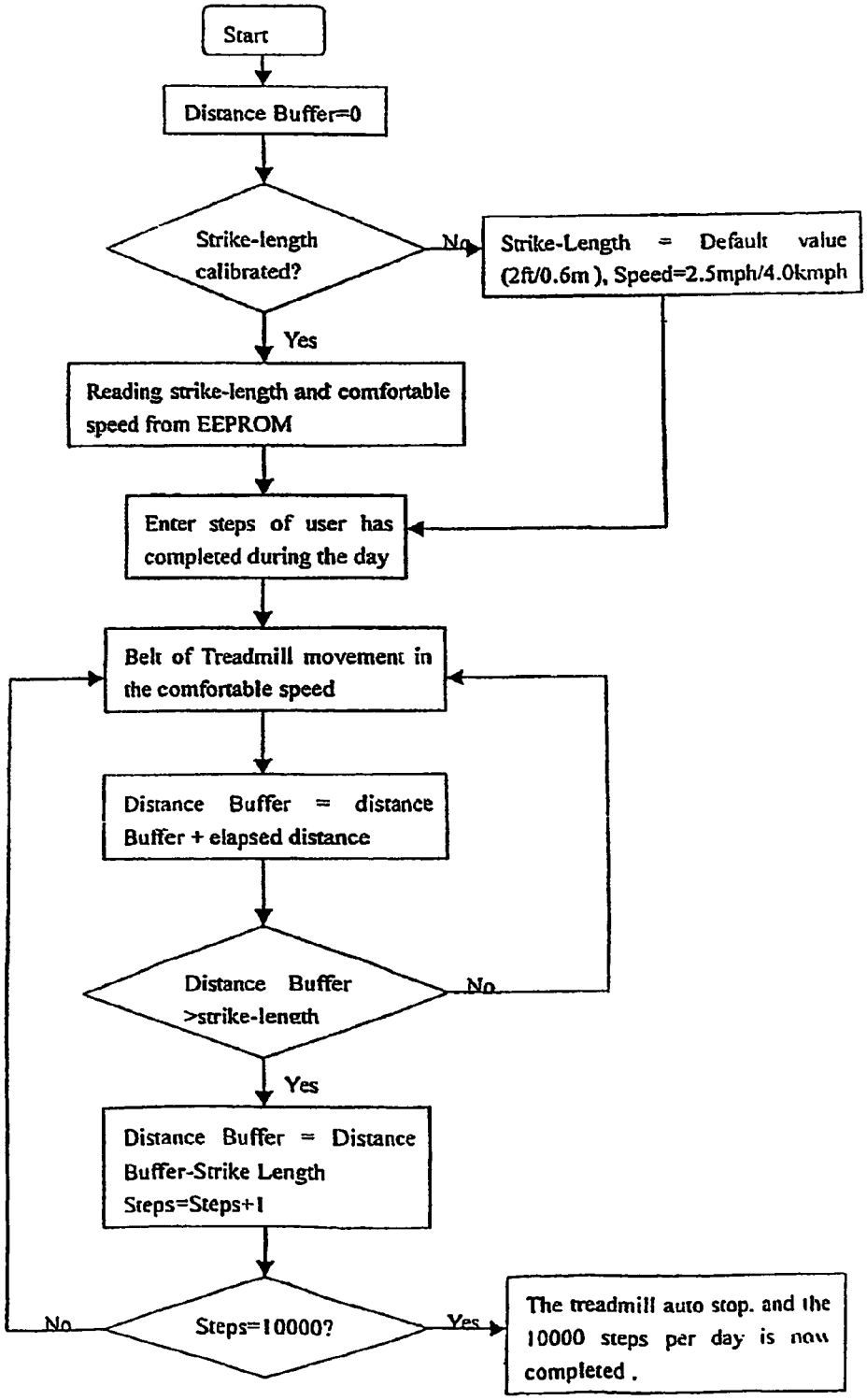
FIG. 2 is a flow chart (Part B) showing how the "10,000 Steps-A-Day" exercise program is completed.
Figure 6:
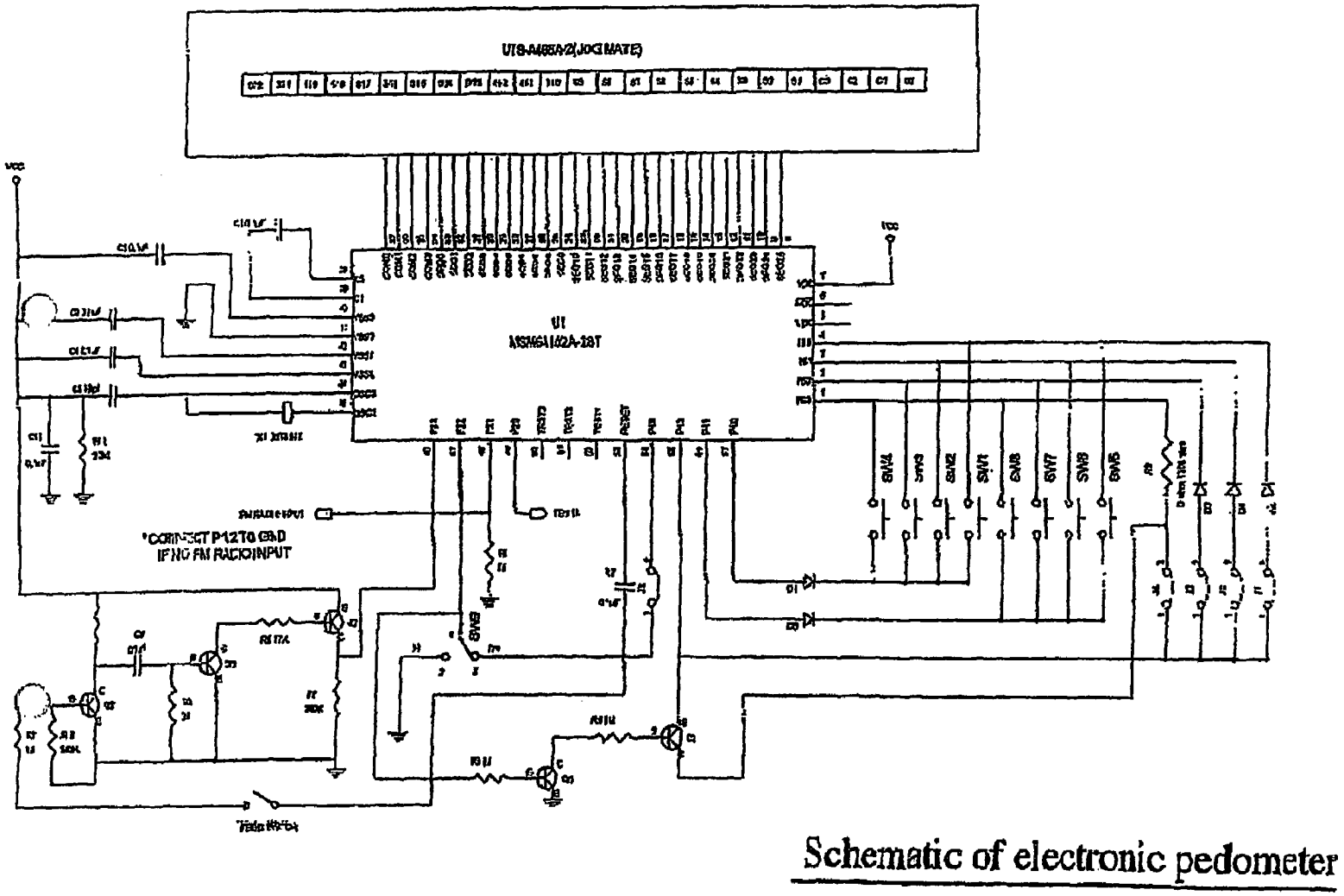
FIG. 6 is a schematic diagram of a circuit for the electronic pedometer shown in FIG. 4.

In FIG. 2, the completion portion of the 10K steps per day program is illustrated beginning with the reading out of the strike-length and comfortable speed from the EEPROM or the use of a default value. The number of steps that the user has completed during the day is then entered as accumulated on a pedometer of the type shown, for example, schematically in FIG. 6. The belt is then adjusted to the saved "comfortable" speed and effectively the number of steps from the pedometer is supplemented by the steps being measured on the treadmill to calculate the elapsed distance and to determine whether the number of steps has equaled 10K. When the number of steps on the treadmill, plus the number of steps entered from the pedometer for the day equals 10K, the treadmill automatically stops.

As noted above, the calibration of the strike-length as well as the completion of the program in the treadmill as shown in FIGS. 1 and 2 is easily implemented in a software program and hardware module with the addition of the 10K-steps button on the treadmill console as shown in FIG. 3B.

Figure 5:
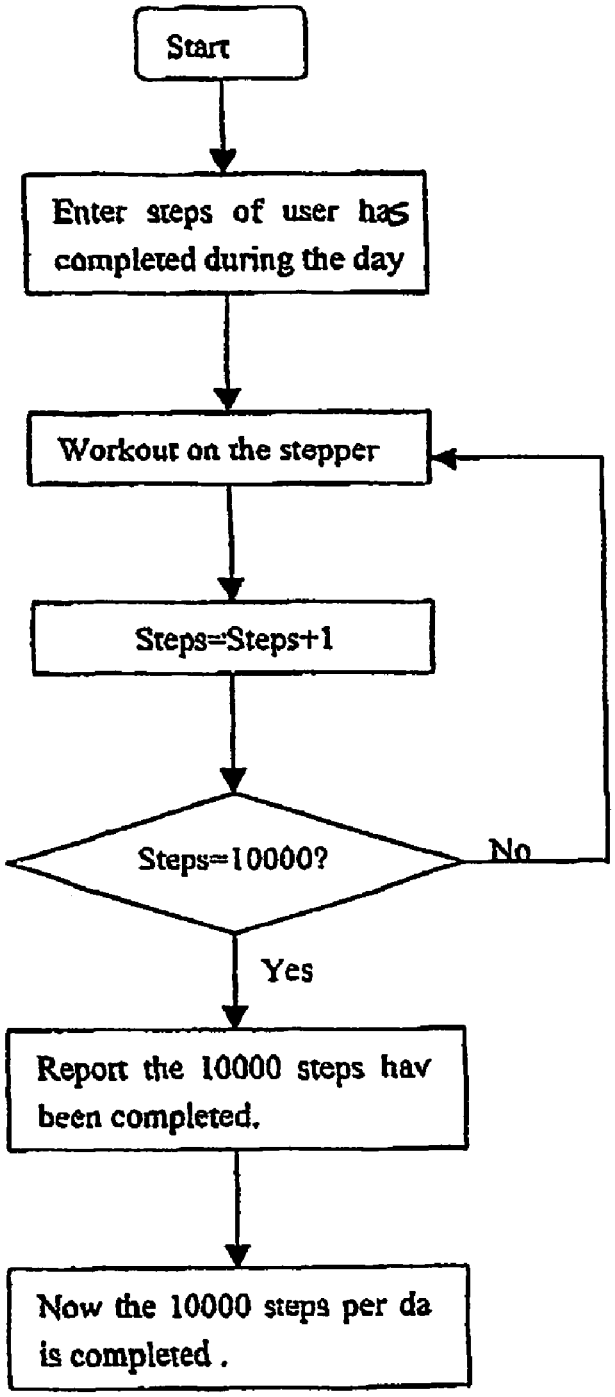
FIG. 5 is a flow chart "10K Steps" program similar to FIGS. 1 and 2 but applied to stepper machine.

FIG. 5 shows how the 10K steps program is utilized in a stepper machine in conjunction with the pedometer. Instead of entering the number of steps the user has completed during the day in a treadmill, the number of steps completed is entered on the stepper. The difference between the number of steps already completed and the 10,000 steps is calculated and the workout pursued as displayed on the stepper.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exercise apparatus comprising:

a console having an input section for receiving a first quantitative input representing exercising units completed by said user away from said exercise apparatus during a predetermined time period;

an exercise surface communicating with said console and providing to said console a second quantitative indication of exercise units performed by said user on said surface;

a summing device for adding together said first and second quantitative unit to provide a total number of quantitative exercise units completed;

comparing means for comparing said total number of said quantitative units completed with a predetermined number.

2. The apparatus according to claim 1, further comprising the step of providing an indication that said total number of quantitative units equals said predetermined number.

3. The apparatus according to claim 1, wherein said exercise apparatus is a stepper machine.

4. The exercise apparatus according to claim 1, wherein said apparatus is a treadmill.

5. An exercising apparatus comprising:

a resettable step counting device providing an output indicating the number of steps taken by a user since being reset;

an exercise machine including a device for determining a strike-length of said user during a first exercise period on said machine as a function of a first output of said step counting device;

a storing device for storing said strike-length;

a calculation device for calculating the number of steps taken by said user during a second exercise period on said machine as a function of said stored strike-length;

an input for inputting a second output of said step counting device;

device for summing the second output of said step counting device and the number of steps taken by said exerciser during said second exercise period to provide a final output indicating a total number of steps; and comparing device for comparing the total number of steps with a predetermined number of steps and stopping said exercise machine when the total number of steps equals said predetermined number.

6. The exercise apparatus according to claim 5, wherein said exercise machine is a treadmill.

7. The exercise apparatus according to claim 6, wherein said treadmill further includes a device for controlling the speed of said treadmill to a user settable speed during said first exercise period, and wherein said treadmill is controlled to function at said user set speed during said second exercise period.

* * * * *